US005346708A

United States Patent [19]

Carson

[11] Patent Number: 5,346,708

[45] Date of Patent: Sep. 13, 1994

[54] THERMOPLASTIC BAG WITH SEPARATE HANDLE AND METHOD OF MAKING SAME

[75] Inventor: John P. Carson, Spartanburg, S.C.

[73] Assignee: W. R. Grace & Co.-Conn., Duncan, S.C.

[21] Appl. No.: 958,393

[22] Filed: Oct. 8, 1992

[51] Int. Cl.[5] ..... B65D 30/00

[52] U.S. Cl. ..... 426/110; 53/442; 206/497; 383/6; 383/12; 383/14; 383/908; 426/129; 426/410; 426/412; 426/413

[58] Field of Search ..... 426/106, 110, 129, 410, 426/412, 413; 383/6-10, 12, 14, 17, 25, 908; 53/442, 557; 206/497

[56] References Cited

U.S. PATENT DOCUMENTS

| | | | |
|---|---|---|---|
| 1,305,797 | 6/1919 | Henderson | 383/12 |
| 2,985,355 | 5/1961 | Read | 383/14 |
| 3,549,085 | 12/1970 | Hart | 229/54 |
| 3,722,377 | 3/1973 | Hayes | 383/14 |
| 3,863,837 | 2/1975 | Spiegel et al. | 229/87 R |
| 4,516,267 | 5/1985 | Kent et al. | 383/22 |
| 4,555,025 | 11/1985 | Weinberg et al. | 206/497 |
| 4,779,996 | 10/1988 | Sengewald | 383/9 |
| 4,958,735 | 9/1990 | Odabashian | 206/497 |
| 4,974,968 | 12/1990 | Mandus et al. | 383/9 |
| 5,120,553 | 6/1992 | Kupcikevicius | 426/129 |

*Primary Examiner*—Donald E. Czaja
*Assistant Examiner*—Anthony Weier
*Attorney, Agent, or Firm*—William D. Lee, Jr.; Mark B. Quatt; George Legg

[57] ABSTRACT

The present invention relates generally to a thermoplastic packaging bag having a carrying handle and relates specifically to a packaging bag having a separate carrying handle. After the bag is loaded with product and closed, the closure securely attaches the handle to the bag.

21 Claims, 2 Drawing Sheets

THERMOPLASTIC BAG WITH SEPARATE HANDLE AND METHOD OF MAKING SAME

BACKGROUND OF THE INVENTION

1. Field of the Invention

The present invention relates generally to a thermoplastic packaging bag having a carrying handle and relates specifically to a packaging bag having a separate carrying handle, such that when a product is placed inside of the bag and the bag closed, the handle is securely attached to the product-containing bag.

2. Description of the Related Art

An accepted method of packaging food and non-food articles such as whole muscle meat products, brick cheese, poultry, toys and the like is through the use of thermoplastic bags which may be heat shrinkable bags, or may be non-heat-shrinkable bags.

In the instance of heat shrinkable thermoplastic bags, the processor loads the article into the bag and evacuates the bag to collapse it about the product. The bag is closed while in its evacuated condition by gathering the open end and clipping or by leaving flat and heat sealing. The sealed bag is then passed through a hot water bath or hot air tunnel or other method of heating to shrink the sealed bag about the product. Shrinking the bag in this fashion closely conforms the bag to the contour of the package. With nonshrinkable bags, packaging is similar, except, of course, there is no shrinking step and generally the bag is not evacuated.

A problem related to packaging large heavy items such as turkeys and the like, particularly vacuum packaging in shrink bags, is that the resulting packaged product is bulky, relatively heavy, usually frozen, and difficult to grasp and lift manually. Thus providing a carrying handle to facilitate handling the vacuum packaged product is desirable. For this purpose several different methods of providing a carrying handle have been developed. A separate handle may be attached to the packaged product at the top open mouth such as handle 30 in U.S. Pat. No. 3,549,085 (Hart, assignor to W.R. Grace). An integral handle may be produced by cutting a cut out in the gathered flap portion of the bag and reinforcing the periphery of the cut out with a grommet to inhibit tear initiation under during carrying or hanging. All of these methods of providing a carrying handle do not solve the problem of the plastic handle ripping, which increases the risk of dropping the product. For instance, ripping could mean the separate handle of '085 could come off the bag. Of course, handle bags for small items and for non-shrink packaging are also desirable.

Often, the handle is formed integral with the bag to avoid the added expense and processing steps of attaching a separate handle to the packaged product. However, an integral handle may require additional material reinforcing devices and the consequent additional processing steps in packaging the product. For instance, in U.S. Pat. No. 4,958,735 (Odabashian), at lines 5–9, the portion with the hole for creating a handle to hang the bag has reinforcing strip 5.

U.S. Pat. No. 4,555,026 (Weinberg et al.) discloses a shrink bag with an integral handle forming portion. The bag is an "extended lip bag" wherein one panel extends beyond the bag open mouth end. As disclosed in this patent, the handle is formed in the extended lip portion by punching a hot die through the lip to provide an opening having a heat seal extending continuously about the opening. This patent also discloses an integral handle wherein both bag panels extend past the product holding area of the bag. The handle is then formed in this dual panel extended lip portion by punching a hot die through the lip to provide an opening having a heat seal extending continuously about the handle opening. When this method is used to produce the integral handle, a slit in one panel of the bag below the fused handle area is required to allow for the product to be placed therein. In either method upon heat shrinking, the extended lip thickens and forms a handle which protrudes longitudinally from the resulting package.

U.S. Pat. No. 5,120,553 (Kupcikevicius, assignor to Viskase) discloses a shrink bag having an integral handle forming portion. The bag is also a so called "extended lip bag" wherein the bag is shaped to receive a turkey in a tail first entry mode and the extended lip portion which has a slit that forms the integral handle is located at the tail end of the package. However, the industry practice of packaging turkeys and other poultry with their wings folded and positioned against the sides of the breast area prevents easy loading of the bird into a bag in a tail first manner. Additionally, breast first loading allows the protective skin flap over the neck bone to remain in position to help prevent bag damage by this sharp neck bone. As a result, commercial packing of turkeys and other poultry is done in a breast first loading orientation. The teaching requires that the handle so formed is drawn to the package closed bottom seal area, preferably over the packaged product itself and does not extend away from the packaged product to allow for easy package pick up by the integral handle. This patent also does not appreciate the advantageous instant handle securely attached to the bag which distributes handle stress more evenly and substantially reduces tearing of the handle of the shrink bag film.

U.S. Pat. No. 4,974,968 (Mandus et al.) discloses a thermoplastic bag with a handle hole and narrow lugs having holes therein. The narrow lugs may be at either end of the bag to allow it to be suspended for filling. Bags of this type are useful for packaging baby diapers for example. Likewise U.S. Pat. No. 4,779,996 (Sengewald), discloses a plastic pouch having pin holes at one end of the pouch to allow it to be suspended for filling. Examples of products suitable for packaging include baby diapers and bread- Neither of these patents appreciates the novel handle of the present invention, nor does it address the problem of load stress on the bag handle during transportation of a heavy product.

U.S. Pat. No. 3,863,837 (Spiegel and Miller) shows a display package with a loop section and a head section, and an opening in the head section to form a handle hanging hole. U.S. Pat. No. 4,516,267 (Kent and Wood, assignors to W. R. Grace) shows a separate handle 8 attached via side seals to side-sealed bag 9.

The disclosures of all the above-mentioned patents are incorporated herein by reference.

OBJECTS AND SUMMARY OF THE INVENTION

One object of the present invention is to provide a flexible thermoplastic bag, preferably a shrink bag, having an attached separate handle. When product is inserted into the bag and the bag closed, the separate handle is securely attached to the bag via the closure means.

Another object is to provide such a bag having a separate attached handle positioned so as not to occlude any portion of the bag opening.

A further object of the present invention is to provide a bag having a separate attached handle portion located at the open mouth end of the bag.

A still further object is to provide a bag having a separate attached handle which is secured to the surface of the resulting package containing a product to allow for easy handle access and which looks like a handle that can be grasped by the hand.

Yet a further object is to provide a bag having a separate attached handle of such a geometry so as during use, when the bag is filled with a product and closed, the geometry distributes more efficiently hang weight stresses and substantially eliminates tearing of the separate handle off of the bag film, particularly if the bag is of shrink bag film.

Yet another object of the present invention is to provide a shrink bag with a separate attached carrying handle wherein the bag is especially adapted for packaging whole body poultry such as turkeys and the like in a breast first loading orientation.

It is an advantage of the present invention that when a heavy object, such as a whole turkey, is packaged in the handle bag of the instant invention, and the bag is clipped closed or heat-sealed closed, then the clip or heat-seal secures the separate attached handle to the bag, thereby distributing stresses and substantially eliminating tearing off of the handle from the plastic bag during use.

It is another advantage of the present invention, since the present invention involves a separate attached handle, not like the U.S. Pat. No. 5,120,553 (Kupcikevicius) disclosure of a shrink bag having an integral handle formed from an "extended lip" whereby the handle is the same material as the bag, that with the instant invention the handle can be of a higher strength material than the material of the bag allowing for lower per package use of high strength material. With '553, if high strength material is wanted for the handle, then the entire bag must be of the same high strength material since the handle is integral.

STATEMENT OF THE INVENTION

One form of the present invention relates to a bag having an open mouth end for loading a product into the bag, a closed bottom end and wherein a handle forming portion of the bag is attached adjacent said open mouth end, so that when product is loaded into the bag and then the open mouth end is closed (by clipping or heat-sealing), the closure will securely attach said handle to the product-containing bag. The bag of the present invention may be used for a variety of products, such as for example, books, toys, whole body poultry, ham, whole turkey breasts, turkey breasts from emulsion, smoke & processed meats, and the like.

The bag of the present invention, particularly in its shrink form, is particularly adapted for use in packaging whole body poultry such as turkeys and the like, ham, smoked and process meats, and cheese. For this reason the bag is described in reference to a preferred packaging use as a turkey or a whole body poultry shrink bag. Thus, it is to be understood that the bag could be of non-heat-shrinkable thermoplastic, and the description below would be essentially the same, except there would be no heat-shrinking step, and in general no step of evacuation of air from the package.

To facilitate its use as a turkey bag, the shrink bag of the present invention has a closed bottom end preferably formed to receive the rounded breast portion of the bird. The closed end of the bag preferably is formed by heat sealing wherein the heat seal is generally concave across the bag to form a bag pocket for receiving the breast end of the bird.

The separate bag handle is attached to the outside of a bag panel such that the handle is disposed near the open mouth end of the bag. The vehicle for attachment may be via a heat seal or may be via adhesive. The attachment may be achieved with a heat seal, as there are known heat sealing apparatus that will afford a sufficient heat and pressure to attach the handle to the outside of a bag panel without creating such an amount of heat and pressure so as to cause that bag panel to heat seal to the other bag panel (for instance when bags are being made from lay-flat tubular film). Of course, if bags are made from a flat sheet of film, then there is no problem of heat sealing a panel to another panel. Such heat sealing apparatus are known to those skilled in the art of packaging and are not further described here. The heat seal attachment of the handle to the outside of a bag panel need not be a strong heat seal, but only sufficient to keep the handle in place during loading the product and closing the bag. Also, the handle may be attached to the outside of a bag panel with adhesive. The adhesive attachment of the handle to the outside of a bag panel need not be strong but only sufficient to keep the handle in place during loading the product and closing the bag.

The separate handle may be attached at the open mouth end during bag making or after the bags are made, and unlike the separate handle of U.S. Pat. No. 4,516,267 (Kent), mentioned above, the instant separate handle is not attached via side seals whereby the Kent separate handle has to be attached during making side sealed bags and is thus limited to side sealed bags. The handle of the instant invention may be of the same or different plastic as the bag, and may or may not be heat-shrinkable. For instance, the handle may be spunbond polyethylene sold by DuPont as TYVEK(R). Since the handle is separate and thus may be of a material different from that of the bag material, then, as mentioned above, the instant handle can be of a higher strength material than the strength of the material of the bag allowing for lower per package use of high strength material, which is in contrast to U.S. Pat. No. 5,150,553 (Kupcikevicius), wherein if high strength material is wanted for the handle, then the entire bag must be of the same high strength material since the handle is integral.

For retail purposes, it is often desirable to attach a tag to the bagged product on which is written the weight, cost or other relevant information regarding the product. Generally, this tag is attached after packaging. However, it is to be understood that such a tag may be attached during the bag manufacturing process. The tag preferably is of a heat sealable plastic film which has little or no heat shrink properties. This allows the entire area of the as-attached tag to be used for alter-applied information such as the weight and price of the product contained in the shrink bag package. Also, it should be kept in mind that generally such tags and labels are adhesively attached. Thus, this also allows for a non-shrink tag or label to be attached to a non-shrink handle on a heat-shrinkable bag, which obviates the shearing, i.e. delamination problem, for when a non-shrink plastic (the tag or label) is adhesively attached to a heat-shrinkable plastic (the bag). Problems of delamination from adhesive attachment of non-shrink plastic to heat-shrinkable plastic are discussed in U.S. Pat. No. 4,755,403 (Ferguson, assignor to W. R. Grace), which is directed to a heat-shrinkable plastic patch material on a heat-shrinkable plastic bag. A suitable plastic film for this purpose of a tag or label has been found to be a sheet of spun bonded linear polyethylene fiber as sold by DuPont under the brand name TYVEK. TYVEK works very nicely for labels since when it is printed with information, such as the weight, cost, and the like, the printing does not distort the TYVEK. Preferably, the tag should be positioned so it does not obscure the handle area at the mouth end of the bag. This is to avoid blocking the easy use of one's hand for grasping the handle, thereby allowing for the safe and easy transportation and handling of the packaged product. The tag may be attached to the bottom end of the bag, such as to the heat seal if the bag is a bottom heat sealed bag. Of course, it is desired that the tag be positioned such that it does not interfere with the handle.

For the preferred arrangement of the handle bag as described above, the bird is loaded breast first through the bag mouth opening. The bag is evacuated and then the bag opening is closed, preferably by gathering it around the tail end of the bird and closing with a metal clip. The clip (or alternatively the heat-seal) captures the ends of the handle thereby securing it to the bag. On subsequent heat shrinking, the bag material produces a substantially wrinkle free, attractive packaged product. Then, the handle is pulled up and over the now-closed bag mouth end. This provides a handle that clearly looks like a handle that can be grasped by the hand. Moreover, providing the handle at the breast end of the bird allows for positioning of the handle like the traditional handle used with netting at the hock end of the bird.

Another form of the present invention relates to a bag comprising: front and rear panels of a thermoplastic material superimposed and laying flat one against the other and defining the front and rear of a bag pocket, the panels having longitudinal side edges joined fluid-tight to form bag pocket side edges and the panels having common ends including a first bottom end, said first end having a first continuous fluid-tight joint forming the bag closed bottom end, and including an opposite open mouth end; a separate handle, having ends and a middle, said separate handle attached at its ends to the outside of a bag panel such that the handle is disposed at the open mouth end, extending from said open mouth end in a direction toward said closed bottom end. The vehicle for attachment of the handle may be a heat seal or may be adhesive. Preferably, the middle of the handle is also attached to the bag panel outside, which should occur approximately half way between the bag mouth end and bag bottom end, as this helps keep the handle in place during product loading and subsequent closing of the bag mouth end. For certain uses, the plastic bag is heat-shrinkable.

Yet another form of the present invention relates to a bag for containing a poultry carcass comprising: front and rear panels of a heat shrinkable thermoplastic film having joined lateral edges, an open mouth end and a closed bottom end, said closed end formed by a heat seal connecting said bag panels, said seal extending transverse to said panels from one lateral side edge to another, forming a pocket contoured to receive a poultry carcass inserted through said open mouth end; said bag having attached to a panel outside a separate handle such that the handle is disposed at the open mouth end, extending from said open mouth end in a direction toward said closed bottom end, said separate handle being for carrying said bag after heat shrinking about a poultry carcass sealed closed or clipped closed within said bag pocket. Preferably, the transverse heat seal at the closed bottom end of the bag is a contour heat seal, thereby forming a generally concave pocket contoured to receive the generally broad rounded breast portion of a poultry carcass inserted breast first through said open mouth end.

A yet further embodiment of the present invention relates to a poultry carcass-containing package comprising: a poultry carcass including breast and tail portions inserted and vacuum packaged in a heat shrunk bag composed of front and rear panels of a heat shrinkable thermoplastic film; said bag having a transverse heat seal forming a first closed bottom end of a bag pocket, said heat seal being made prior to inserting said poultry carcass into said bag; said bag having a second closed mouth end formed after the insertion of said poultry carcass into said bag; and a separate handle, having ends and a middle, said separate handle securely attached to said bag at said closed mouth end, said secured attachment being accomplished by said closure of said mouth being via a clip or heat seal capturing the ends of said handle whereby during use said handle is pulled up and over the closed mouth end, extending outwardly in a direction away from said second closed mouth end. Preferably, the transverse heat seal at the bag bottom is contoured to accommodate the shape of an end of said carcass, more preferably contoured to accommodate said carcass breast portion.

The present invention further encompasses a method of making a thermoplastic bag having a separate attached carrying handle comprising: (1) providing front and rear bag panels of a thermoplastic heat sealable material which are superimposed and lay flat one against the other, said panels being joined fluid-tight along side edges to form sides of a bag pocket and having common ends including a first bottom end and an opposite open mouth end, said first bottom end defining a fluid-tight closed bottom end of said bag pocket and (2) attaching a handle, the handle having ends and a middle, by attaching to one panel outside at the mouth end, the ends of the handle, and attaching to the middle of said one panel outside, the middle of said handle, whereby said handle is disposed along said one panel outside, going from the mouth end in a direction toward said closed bottom end. The method may include said fluid-tight closed bottom end being formed by heat sealing said bag panels together at said first bottom end with a first continuous transverse heat seal. Also said panels may be heat-shrinkable plastic.

A further method embodied by the present invention relates to forming a product-containing package with separate securely attached carrying handle comprising: providing a bag having front and rear panels of a heat shrinkable thermoplastic film defining the sides of a product-receiving bag pocket, the bag having: i) a closed bag pocket bottom end formed by a transverse heat seal contoured to accommodate an end of a product inserted into said bag pocket through a bag open mouth end opposite the closed bag pocket bottom end, and a handle, having ends and a middle, said handle attached at its ends to the outside of one bag panel at the mouth end, and optionally attached at, preferably, its middle to the middle of the outside of said one bag panel, whereby said handle is disposed along said one panel outside, going from the mouth end towards said closed bottom end; inserting a product through said bag open mouth end; evacuating said bag to collapse it about said product and then effecting an air-tight closure of said bag open mouth end whereby said closure captures the ends of said handle thereby securely attaching said handle to said bag; and then heat shrinking said product-containing bag to form a taut, generally wrinkle-free package; pulling said handle up and over the now closed mouth end thereby providing a handle for gripping and lifting said product-containing package. If the handle has been attached at its middle to the middle of the outside of said one bag panel, then the pulling includes pulling said handle from its middle attachment off the middle of the outside of said one bag panel.

Thus the bag (which may be a heat shrinkable bag) having a carrying handle of the present invention provides a separate (but securely attached by the bag closure during product packaging) handle which is located at the prepackaging open mouth end of the bag. Further, the handle works best when it does not shrink over and across the packaged product, but instead protrudes longitudinally and is thus accessible for the user at the mouth end of the product-containing bag. These features further result in a product-containing bag (which may be a heat shrinkable bag) having a separate but securely attached carrying handle which prevents high stress concentrations and prevents tear propagation of the handle off of the bag when the handle is subjected to abusive conditions. Preferred forms of the bag with handle, as well as other embodiments, objects, features and advantages of this invention, will be apparent from the following detailed description, and illustrative embodiments thereof, which are to be read in connection with the accompanying drawings.

DETAILED DESCRIPTION AND DESCRIPTION OF THE DRAWINGS

Figure 1:
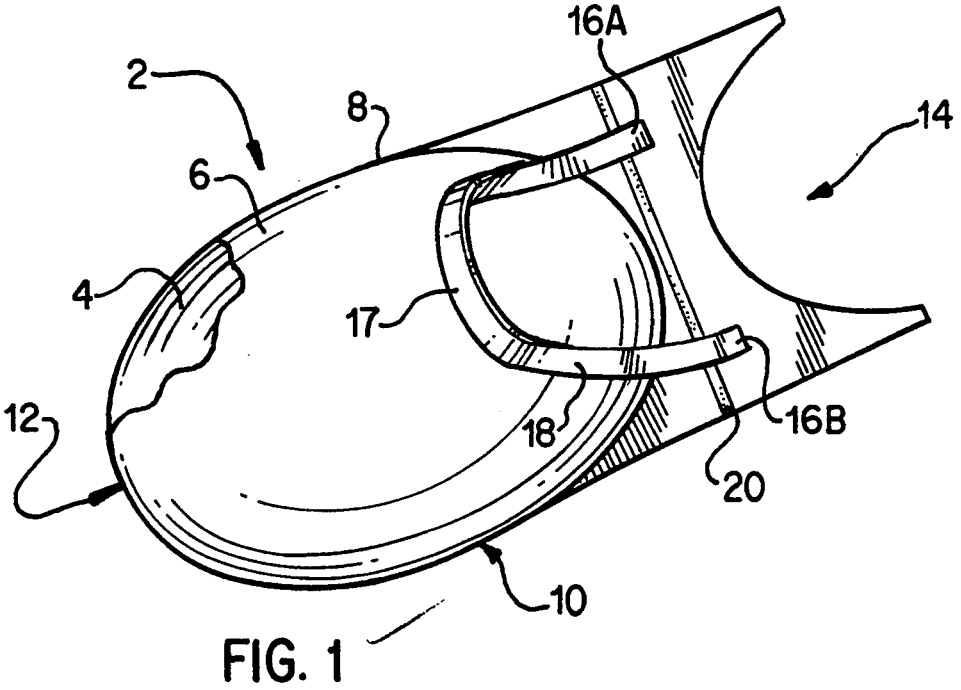
FIG. 1 shows a bag of the present invention generally indicated in its lay-flat condition, prior to its packaging use, the bag having a separate attached handle.

The present invention will be better understood from the specification taken in conjunction with the accompanying drawings in which like reference numerals refer to like parts.

In FIG. 1, there is shown a bag of the present invention generally indicated at 2 in its lay-flat condition, prior to its packaging use. The bag is made of any suitable thermoplastic packaging film commonly used for packaging products. The bag may be of heat-shrinkable thermoplastic packaging film, and may be used for the vacuum shrink packaging of product, particularly food products, such as poultry. Suitable thermoplastic films include, for example, oriented (heatshrinkable) film that is barrier film (has low oxygen permeability) such as disclosed in U.S. Pat. No. 3,741,253 (Brax et al), and heat-shrinkable films containing very low density linear polyethylene and an oxygen barrier layer such as vinylidene chloride copolymer or ethylene vinyl alcohol copolymer, such as disclosed in U.S. Pat. No. 4,863,769 (Lustig et al). For turkey and other poultry packaging, preferred is biaxially oriented multi-layer film such as disclosed, for example, in U.S. Pat. No. 4,617,241 (Mueller). Cook-in film, such as disclosed in U.S. Pat. No. 4,879,124 (Oberle), could also be used, particularly where the intended end-use is cook-in of packaged poultry. The disclosures of all these patents are incorporated herein by reference.

Typically, such plastic films are made via tubular extrusion, and may be made heat-shrinkable using one of the various well known bubble methods. This tube is collapsed to a lay-flat condition to provide superimposed front and rear bag panels having seamless side edges. The laid-flat tube is then heat-sealed, liquid-tight across its width to form a closed bag bottom end, and then is cut at a location spaced from the bottom end heat seal to provide an open mouth bag end. It is also well known that plastic films may be made in a flat sheet form, and that such are made heat-shrinkable using the well known tenter frame method.

In accordance with this practice, FIG. 1 shows the bag 2 to have superimposed rear panel 4 and front panel 6. The front and rear panels lay-flat one against the other. The panels are joined along lateral side edges 8,10. If the bag is made of a collapsed tube, as noted above, then the side edges 8,10 are seamless. Otherwise, one or both side edges 8,10 contain a fluid-tight seam such as formed by heat sealing or an adhesive for connecting the panels. The panels B,10 have con, non ends 12, 14, wherein 14 is the open mouth end of the bag. The panels at end 12 are optionally connected such as by heat sealing the panels together. Alternatively, if the bag is a side-sealed bag, then as is typical in the industry, the bag would be made by folding over a flat sheet of plastic to form side-seals, which would be located at 8,10, and then bag bottom end 12 would be seamless as it would be a folded piece of plastic and sides 8,10 would be heat-sealed closed.

The shape of bottom end 12 is not critical and may be any shape that provides the desired amount of material, and optionally the desired shape depending on the intended product to be packaged in the bag. Preferably, when bottom end 12 is formed by a heat seal, it is shaped to conform generally with the end of the product to be inserted into the bag, and against the bottom of the bag. In one embodiment of the bag for use in packaging whole poultry, the heat seal provides a rounded cavity shape able to accommodate the breast configuration of the breast end of a bird such as turkey or the like.

Thus, the panels 4, 6 form a bag pocket for containing an article to be packaged which is inserted into the bag through the open mouth end 14. Bag panels 4, 6 form the sides of the bag pocket. Separate handle 18 is shown adhesively to the bag front panel 6 at handle ends 16A, 16B. In addition, as clearly shown in FIG. 1, each handle end has a contiguous depending portion extending to the handle middle, 17. Also, as shown in FIG. 1, when said contiguous ends are in an unfolded state, each of said contiguous depending portions extends in a direction toward the bottom end of said bag and said handle middle is positioned below said mouth end. It is noted that handle ends 16A, 16B could be attached to the bag panel 6 via a heat seal. To assist in keeping the handle in place during bag loading of a product into mouth end 14, handle 18 is preferably also attached to bag panel 6 at handle middle 17, such as by adhesive. The vehicle for attachment of the handle middle 17 also may be a heat seal. After product loading into the bag via open mouth end 14, the bag is closed via a closure 20, which is illustrated as dotted line 20, such as by a clip or heat seal, further illustrated in FIG. 2.

Figure 2:
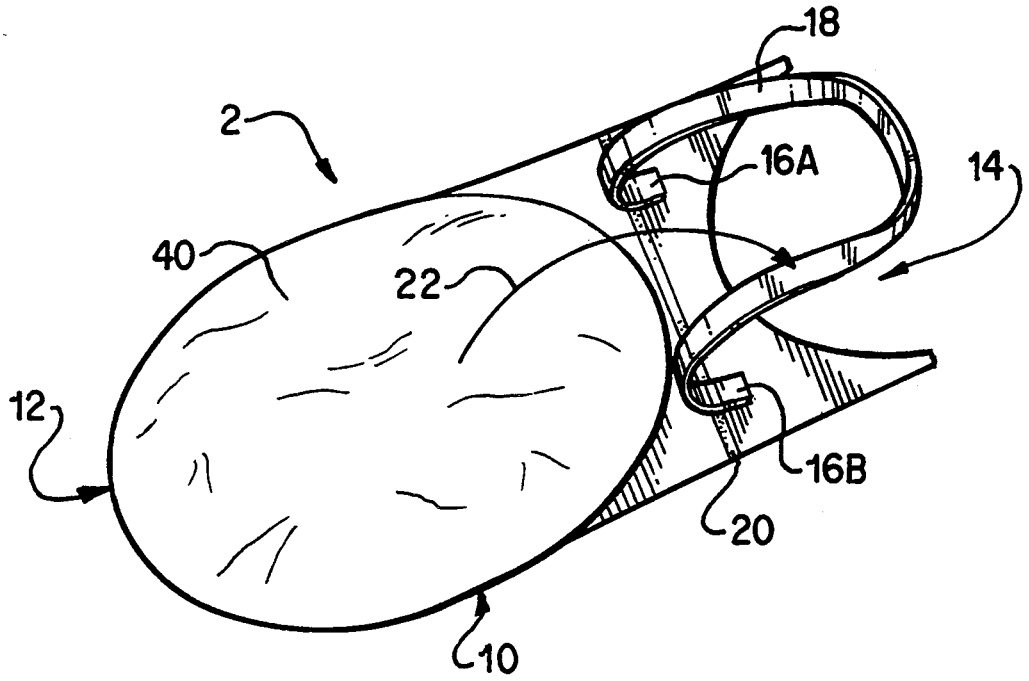
FIG. 2 shows the bag of FIG. 1 after it has been packaged with a product and then closed with a closure means.

In FIG. 2, is shown the bag 2 after it has been packaged with product 40 and then closed at closure 20, which may be a heat seal or a clip, near mouth end 14. As illustrated in FIG. 2, closure 20 captures the ends 16A, 16B of handle 18, thereby securely attaching handle 18 to bag 2. If the bag is of heat shrinkable material, then the product-containing bag may be placed in a hot air or hot water shrink tunnel at this point to heat shrink the bag forming a taut fit about the product. In FIG. 2, closure 20 comprises a heat seal, but alternatively could comprise a clip. As shown in Figure 1, handle ends 16A, 16B were disposed in separate places on panel 6 toward bag sides 8,10, respectively, but near bag mouth end 14, so that when heat seal 20 was made as shown in FIG. 2, heat seal 20 captured these handle ends 16A, 16B. As further shown in FIG. 2, handle 18 is pulled from its middle adhesive attachment 17, up and over the now closed mouth end 14, thereby providing a handle for gripping and lifting said product-containing package. This provides a handle that clearly looks like a handle that can be grasped by the hand of the person using the packaged product. It is noted the handle may be of the same plastic as the bag, may be another type of plastic, or may be non-plastic material.

In the preferred embodiment, for the packaging of poultry, particularly whole turkeys which are heavy, the bag is of a heat-shrinkable thermoplastic material. The bag mouth end 14 is closed via a clip 20, said clip 20 capturing the handle ends 16A, 16B, whereby after the bag containing the turkey is heat shrunk, the handle is pulled up and over the closed mouth end 14, extending outwardly in a direction, as indicated by arrow 22, away from said closed mouth end 14. Of course, for the shrink-bag use, for turkey or other products, the handle could be pulled up and over the closedmouth end 14 prior to heat shrinking, but that would not be desired as the handle would be more likely to be caught up as the package went through the shrink tunnel.

Figure 3:
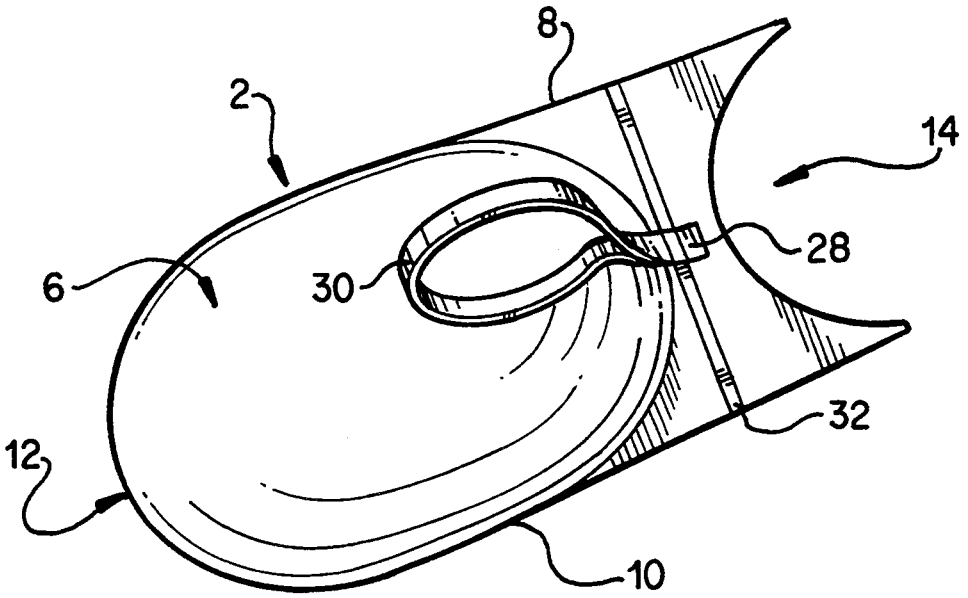
FIG. 3 shows a bag of the present invention generally indicated in its lay-flat condition, prior to its packaging use, the bag having a separate attached handle which is an alternative embodiment to the handle shown in FIG. 1.

In FIG. 3 is shown an alternative embodiment of the handle, as illustrated by handle 26. Handle 26 is shown adhesively attached at handle ends 28A, 28B, which are shown in FIG. 3 with 28A adhesively attached to 28B, which in turn is adhesively attached to bag panel 6 near mouth 14, approximately in the middle between sides 8,10. Of course, ends 28A, 28B could also be attached by a heat seal. In addition, as clearly shown in FIG. 3, each handle end has a contiguous depending portion extending to the handle middle, 30. Also, as shown in FIG. 3, when said ends are in an unfolded state, each of said contiguous depending portions extends in a direction toward the bottom end of said bag and said handle middle is positioned below said mouth end. Preferably, handle is also adhesively attached to panel 6 at handle middle 30, to help keep the handle in place during loading of bag 2 with product via bag mouth 14. Of course, handle middle 30 could also be attached with a heat seal. After loading with product, the bag is then closed at closure 32, illustrated by dotted line 32 in FIG. 3, and further described in FIG. 4.

Figure 4:
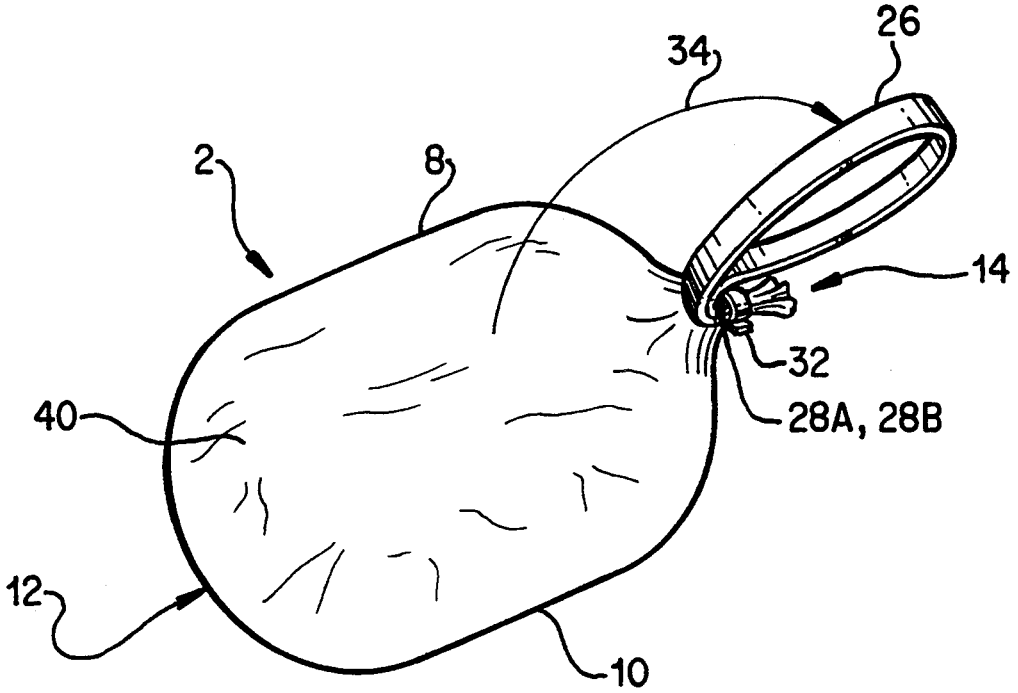
FIG. 4 shows the bag of FIG. 3 after it has been packaged with a product and then closed with a closure means.

In FIG. 4, the bag 2 is shown closed via closure 32, illustrated in FIG. 4 by clip 32 after insertion of product 40 into bag 2. Clip 32 securely attaches handle ends 28A, 28B to bag 2. After closure, handle 26 is then pulled from its adhesive attachment at its middle 30 to bag panel 6 so that the handle is up and over clip 32 and now closed mouth end 14, thereby providing a handle for gripping and lifting said product-containing package, with the handle protruding longitudinally in the direction indicated by arrow 34, and thus being accessible for the user at the mouth end of the bag.

Although the illustrated embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A bag comprising:

(a) front and rear panels of a thermoplastic material superimposed one against the other and defining a front and rear of a bag pocket, the panels joined to each other at respective longitudinal side edges to form bag pocket side edges and the panels having common ends including:

(i) a first bottom end, the first end having a first continuous joint forming a closed bottom end; and (i) an opposite open mouth end; and (b) a separate handle, having ends and a middle, the separate handle attached at its ends to one of the bag panels near the open mouth end, each end of the handle having a contiguous depending portion extending to the middle of the handle, and such that when said contiguous depending portions are in an unfolded position, said middle is positioned below said closed bottom end and said contiguous depending portions extend toward the closed bottom end.

2. The bag of claim 1, where the handle ends are attached to one of the bag panels by adhesive or by a heat seal.

3. The bag of claim 1, where the middle of the handle is attached to one of the bag panels.

4. The bag of claim 3, where the middle of the handle is attached to one of the bag panels by adhesive or by a heat seal.

5. The bag of claim 1, where the bag is heat-shrinkable.

6. A bag comprising:

(a) front and rear panels of a thermoplastic film joined to each other at respective longitudinal edges;

(b) an open mouth end;

(c) a closed bottom end formed by a heat seal connecting the bag panels, the seal extending transverse to the panels from one longitudinal side edge to another, forming a pocket to receive a product inserted through the open mouth end;

(d) a separate handle, having ends and a middle, such that the handle is attached at its ends to one of the bag panels near the open mouth end, each end of the handle having a contiguous depending portion extending to the middle of the handle, and such that when said contiguous depending portions are in an unfolded position, said middle is positioned below said closed bottom end and said contiguous depending portions extend toward the closed bottom end.

7. The bag of claim 6, wherein the transverse heat seal at the closed bottom end of the bag is a contour heat seal, thereby forming a generally concave pocket contoured to receive a breast portion of a poultry carcass inserted breast first through the open mouth end.

8. The bag of claim 6, where the ends of the handle are attached to one of the bag panels by adhesive or by a heat seal.

9. The bag of claim 6, where the middle of the handle is attached to one of the bag panels.

10. The bag of claim 9, where the middle of the handle is attached to one of the bag panels by adhesive or by a heat seal.

11. A method of making a thermoplastic bag having a separate attached carrying handle comprising:

(1) providing front and rear bag panels of a thermoplastic heat sealable material superimposed one against the other, the panels being joined to each other at respective side edges to form sides of a bag pocket, the panels having common ends including a first bottom end and an opposite open mouth end, the first bottom end defining a closed bottom end of the bag pocket; and (2) attaching a handle, the handle having ends and a middle, to the bag by attaching the ends to one of the bag panels near the open mouth end, each end of the handle further having a contiguous depending portion extending to the middle of the handle, and such that when said contiguous depending portions are in an unfolded position, said middle is positioned below said closed bottom end and said contiguous depending portions extend toward the closed bottom end.

12. The method of claim 11, wherein the closed bottom end is formed by heat sealing the bag panels together at the first bottom end with a continuous transverse heat seal.

13. The method of claim 11, wherein the transverse heat seal at the closed bottom end is contoured to accommodate a product to be packaged inside the bag.

14. The method of claim 11, where the ends of the handle are attached to one of the bag panels by a heat seal.

15. The method of claim 11, where the middle of the handle is attached to one of the bag panels.

16. The method of claim 15, where the middle of the handle is attached to one of the bag panels by adhesive or by a heat seal.

17. The method of claim 11, where the bag is stretch oriented to make it heat-shrinkable.

18. A method of making a product containing package with separate attached carrying handle comprising:

(a) providing a bag having front and rear panels of a thermoplastic film, the panels being joined to each other at respective side edges to form sides of a product-receiving bag pocket, the bag having:

(i) a closed bag pocket bottom end formed by a transverse heat seal contoured to accommodate an end of a product inserted into the bag pocket through an open mouth end opposite the closed bag pocket bottom end, and (ii) a handle, having ends and a middle, the handle attached at its ends to one of the bag panels at the mouth end, and optionally attached at its middle to said one bag panel, each end of the handle further having a contiguous depending portion extending to the middle of the handle, and such that when said contiguous depending portions are in an unfolded position, said middle is positioned below said closed bottom end;

(b) inserting a product through the open mouth end;

(c) evacuating the bag to collapse it about the product;

(d) activating a means for closing to (i) close the bag open mouth end and, at the same time, (ii) attach the ends of the handle to the bag;

(e) heat shrinking the product containing bag; and (f) pulling the handle up and over the mouth end thereby providing a handle for gripping and lifting said product-containing package.

19. The method of claim 18, where the ends of the handle are attached to one of the bag panels by adhesive or by a heat seal.

20. The method of claim 18, where the middle of the handle is attached to one of the bag panels, whereby the pulling step includes pulling the middle of the handle off the bag panel.

21. The method of claim 20, where the middle of the handle is attached to the bag panel by adhesive or by a heat seal.

* * * * *